US011242735B2

(12) United States Patent
Storslett et al.

(10) Patent No.: US 11,242,735 B2
(45) **Date of Patent: *Feb. 8, 2022**

(54) SYSTEM AND PROCESS FOR RECOVERING HYDROCARBONS USING A SUPERCRITICAL FLUID

(71) Applicant: CHEVRON U.S.A. INC., San Ramon, CA (US)

(72) Inventors: Stein J. Storslett, Bakersfield, CA (US); John Segerstrom, San Ramon, CA (US)

(73) Assignee: Chevron U.S.A. INC., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/164,294

(22) Filed: Feb. 1, 2021

(65) Prior Publication Data

US 2021/0156237 A1 May 27, 2021

Related U.S. Application Data

(63) Continuation-in-part of application No. 13/763,458, filed on Feb. 8, 2013, now Pat. No. 10,907,455.

(51) Int. Cl.
*E21B 43/24* (2006.01)

(52) U.S. Cl.
CPC ..... *E21B 43/24* (2013.01)

(58) Field of Classification Search
CPC ..... E21B 43/24
See application file for complete search history.

(56) References Cited

U.S. PATENT DOCUMENTS

| | | | | |
|---|---|---|---|---|
| 4,648,455 | A * | 3/1987 | Luke | E21B 43/162 166/242.2 |
| 4,648,755 | A | 3/1987 | Stashko | |
| 5,984,010 | A | 11/1999 | Elias et al. | |
| 9,593,563 | B2 | 3/2017 | Johnsen et al. | |
| 10,215,399 | B2 | 2/2019 | Costanzo et al. | |
| 10,907,455 | B2 | 2/2021 | Segerstrom | |

(Continued)

FOREIGN PATENT DOCUMENTS

WO 2013050975 A1 4/2013

OTHER PUBLICATIONS

Office Action (CA 2,841,657), dated Feb. 5, 2020.

*Primary Examiner* — Angela M DiTrani Leff
*Assistant Examiner* — Avi T Skaist
(74) *Attorney, Agent, or Firm* — Hunton Andrews Kurth LLP

(57) ABSTRACT

A process is provided for recovering hydrocarbons, such as heavy oils, from a subterranean reservoir. The process includes providing a subcritical or a supercritical aqueous fluid at a high temperature and high pressure to the underground hydrocarbon reservoir, injecting the aqueous fluid into the reservoir to heat the hydrocarbons in the reservoir, and recovering the heated hydrocarbons from the reservoir. In some cases, the supercritical fluid is also used to upgrade the hydrocarbons and/or facilitate the transportation of the hydrocarbons from the production field to another location, such as a refinery. Advantageously, isentropic expansion may be employed anywhere in the system for a more efficient and effective processes and systems.

19 Claims, 7 Drawing Sheets

(56) References Cited

U.S. PATENT DOCUMENTS

| | | | | |
|---|---|---|---|---|
| 2003/0062163 | A1 | 4/2003 | Moulton et al. | |
| 2005/0126784 | A1 | 6/2005 | Dalton | |
| 2008/0302523 | A1 | 12/2008 | Wegener et al. | |
| 2009/0139715 | A1* | 6/2009 | Choi | C10G 9/00 166/272.1 |
| 2009/0236092 | A1* | 9/2009 | O'Brien | E21B 43/2406 166/256 |
| 2010/0031652 | A1 | 2/2010 | Schnell | |
| 2010/0031653 | A1* | 2/2010 | Foppe | E21B 43/17 60/641.3 |
| 2010/0163226 | A1 | 7/2010 | Zornes | |
| 2010/0288497 | A1 | 11/2010 | Burnham et al. | |
| 2011/0036580 | A1 | 2/2011 | Morrow et al. | |
| 2011/0180262 | A1 | 7/2011 | O'Dowd | |
| 2011/0198078 | A1 | 8/2011 | Harrigan et al. | |
| 2011/0211997 | A1 | 9/2011 | O'Dowd | |
| 2016/0214878 | A1 | 7/2016 | Weimer et al. | |

* cited by examiner

SYSTEM AND PROCESS FOR RECOVERING HYDROCARBONS USING A SUPERCRITICAL FLUID

CROSS-REFERENCE TO RELATED APPLICATIONS

The present application is a continuation-in-part of U.S. Ser. No. 13/763,458 filed Feb. 8, 2013 which application was allowed on Sep. 23, 2020 and which will issue on Feb. 2, 2021 as U.S. Pat. No. 10,907,455 and which application is incorporated herein by reference in its entirety.

TECHNOLOGICAL FIELD

The present disclosure relates to a process for recovering hydrocarbon fluids and, in some cases, partially upgrading and/or transporting the hydrocarbon fluids. More particularly, the present disclosure relates to a process for recovering, partial upgrading and transporting hydrocarbons using an aqueous fluid at supercritical conditions.

BACKGROUND

Oil recovered, or produced, and transported from a significant number of oil reserves around the world is simply too heavy to flow under reservoir and ambient conditions. This makes it challenging to bring remote, heavy oil resources closer to the markets where refining facilities are accessible.

In order to render such heavy oils flowable in the reservoir and production well(s), one conventional method known in the art is to use two phase saturated steam generation and distribution. That method typically presents a challenge in achieving sufficiently uniform distribution of latent heat in the reservoir. Latent heat profile control devices are known and used in the industry to distribute vapor and liquid phases more evenly at the perforations; however, installation and retrieval this equipment can be increase the complexity and cost of a hydrocarbon production operation, and the difficulty of installing and retrieving the equipment can be further increased in horizontal wells by the bend radius at the heel of the well and the sand that can settle to the bottom of the casing.

Once heavy oil is produced from a well, it is conventional practice in the industry to facilitate the transport of the heavy oil by heating it to a high temperature and maintaining high pressure in insulated shipping pipelines.

Also, in order to render such heavy oils flowable, one common method known in the art is to reduce the viscosity and density of the heavy oil by mixing the heavy oil with a sufficient diluent. The diluent may be naphtha, syncrude, or any other fluid stream that has a sufficiently higher API gravity (i.e., much lower density) than the heavy oil. Typically, this heavy oil must be taken to an upgrader either in the field or at some remote central location before shipment to a refinery.

In one conventional heavy oil production operation, diluted crude oil is sent from the production wellhead via a pipeline to an upgrading facility. Two key operations occur at the upgrading facility: (1) the diluent stream is recovered and recycled back to the production wellhead in a separate pipeline, and (2) the heavy oil is upgraded with suitable technology known in the art (coking, hydrocracking, hydrotreating, or the like) to produce higher-value products for market. Some typical characteristics of these higher-value products include: lower sulfur content, lower metals content, lower total acid number (TAN), lower residuum content, higher API gravity, and lower viscosity. Most of these desirable characteristics are achieved by reacting the heavy oil with hydrogen gas at high temperatures and pressures in the presence of a catalyst. Depending on the location of the upgrading facility and other market factors, the upgraded crude might be sent to the end-users via tankers and/or additional pipelines.

These diluent addition/removal processes and hydrogen-addition or other upgrading processes can be undesirable in some cases. For example, the infrastructure required for the handling, recovery, and recycling of diluent can be expensive, especially over long distances, and diluent may not be readily availability at a reasonable price. The hydrogen-addition processes such as hydrotreating or hydrocracking typically require significant investments in capital and infrastructure which add to the total cost of producing the heavy oil. The hydrogen-addition processes also typically have high operating costs, since hydrogen production costs are highly sensitive to natural gas prices. Some remote heavy oil reserves may not even have access to sufficient quantities of low-cost natural gas to support a hydrogen plant. These hydrogen-addition processes also generally require expensive catalysts and resource intensive catalyst handling techniques, including catalyst regeneration. In some cases, the refineries and/or upgrading facilities that are located closest to the production site may have neither the capacity nor the facilities to accept the heavy oil. Additionally, coking is often used at refineries or upgrading facilities. Sulfur is removed prior to the coking process, and significant amounts of by-product solid coke are produced during the coking process, leading to lower liquid hydrocarbon yield. In addition, the liquid products from a coking plant often need further hydrotreating. Further, the volume of the product from the coking process is significantly less than the volume of the feed crude oil.

For these and other reasons, there exists a continued need for improved systems and processes for recovering hydrocarbon fluids, particularly heavy oils.

SUMMARY OF THE INVENTION

The present disclosure provides a system and process for recovering hydrocarbons using a supercritical fluid, such as supercritical water.

In one embodiment, the system a source for providing a first aqueous fluid, such as drinking water, treated wastewater, untreated wastewater, river water, lake water, seawater, or produced water. The system also includes a heater for receiving the first aqueous fluid and heating the first aqueous fluid to a temperature from 374° C. to 1000° C. at a pressure from 3205 to 10000 psia, such that the first aqueous fluid is in a supercritical phase (also referred to and understood herein to be a supercritical state), a delivery system configured to receive the first aqueous fluid from the heater and delivery the first aqueous fluid for injection into an underground hydrocarbon reservoir in the supercritical phase, and a well configured to recover from the reservoir hydrocarbons that have been heated by the first aqueous fluid. One or more venturi chokes can be disposed in the reservoir, e.g., in a horizontal portion of a well that extends through at least part of the reservoir, and configured to inject the supercritical, dense-phase fluid so that the first aqueous fluid flashes across the venturi choke(s) as it is injected.

In some cases, the system is configured to mix a second aqueous fluid with the recovered hydrocarbons at conditions sufficient to upgrade at least a portion of the hydrocarbons. The system can be configured to provide the second aqueous fluid in a supercritical phase.

The present disclosure also provides a process for recovering hydrocarbons, such as whole heavy petroleum crude oil and tar sand bitumen. According to one embodiment, the process includes providing a first aqueous fluid in a supercritical phase at a temperature from 374° C. to 1000° C. and a pressure from 3205 to 10000 psia to an underground hydrocarbon reservoir. The first aqueous fluid can be drinking water, treated wastewater, untreated wastewater, river water, lake water, seawater, produced water, or mixtures thereof. The first aqueous fluid is injected into the underground hydrocarbon reservoir to heat the hydrocarbons. The heated hydrocarbons are recovered from the reservoir. In some cases, the step of injecting the first aqueous fluid includes delivering the first aqueous fluid through a wall of a wellbore (e.g., through a venturi choke installed in the wall of the wellbore) to the hydrocarbon reservoir. For example, the first aqueous fluid can flash across a venturi choke from a steam or fluid injector into the underground hydrocarbon reservoir, such as by flashing the first aqueous fluid to at least 70% steam quality.

In some embodiments, the process also includes mixing a second aqueous fluid with the recovered hydrocarbons at conditions sufficient to upgrade at least a portion of the hydrocarbons. The second aqueous fluid can be in the supercritical phase, and/or the mixing of the fluids can occur in a wellbore or production pipeline. The step of upgrading can include reducing the viscosity of at least a portion of the hydrocarbons. For example, the upgrade operation can be characterized by a reaction residence time from 8 minutes to 2 hours. The first aqueous fluid and the second aqueous fluid can be generated individually or in a single supercritical fluid generation operation, e.g., from a modified steam generator or modified heat recovery steam generator. In some cases, the first aqueous fluid and the second aqueous fluid are generated from a 50 millions BTU/HR modified oilfield steam generator. One or more heat exchangers, e.g., achieved in a wellbore or pipeline or other similar equipment can be used to achieve heat exchange between the second aqueous stream and the recovered hydrocarbons before mixing.

In one embodiment the instant application pertains to a process for recovering hydrocarbons. The process comprises making a supercritical dense phase fluid comprising water suitable for heating hydrocarbons. The first supercritical dense phase fluid is generated by heating water to a supercritical dense phase at a temperature from 374° C. to 1000° C. and a pressure from 3205 to 10000 psia at a surface location. The first supercritical phase fluid is flashed to a range of about 70% to 100% steam quality or superheated steam to heat the hydrocarbons with the about 70% to 100% steam quality or superheated steam.

In another embodiment the application pertains to a system for recovering hydrocarbons. The system comprises a supercritical phase fluid comprising water heated to a temperature from 374° C. to 1000° C. at a pressure from 3205 to 10000 psia. The system also comprises a delivery system configured to receive the supercritical phase fluid and deliver the supercritical phase fluid to hydrocarbons to heat the hydrocarbons to reduce viscosity of at least a portion of the hydrocarbons. The delivery system is configured such that the supercritical phase fluid drops in pressure and flashes to a range of about 70% to 100% steam quality or superheated steam prior to contacting the hydrocarbons. A well configured to recover the heated hydrocarbons.

In another embodiment the application pertains to a process for recovering hydrocarbons, comprising making a supercritical dense phase fluid comprising water suitable for heating hydrocarbons. The supercritical dense phase fluid is generated by heating water to a supercritical dense phase at a temperature from 374° C. to 1000° C. and a pressure from 3205 to 10000 psia. The supercritical phase fluid is isentropically expanded to a range of about 70% to 100% steam quality or superheated steam to heat the hydrocarbons with the about 70% to 100% steam quality or superheated steam.

In another embodiment the application pertains to a system comprising a distribution piping system configured to receive a subcritical phase fluid, a supercritical phase fluid, or any combination thereof. The system comprises an isentropic expansion device operably connected to the distribution piping system. The isentropic expansion device is configured to expand the subcritical phase fluid, the supercritical phase fluid, or any combination thereof to a range of from about 70% to 100% steam quality or superheated steam prior to said 70% to 100% steam quality or superheated steam heating one or more hydrocarbons. A well is configured to recover heated hydrocarbons.

DETAILED DESCRIPTION

The present disclosure now will be described more fully hereinafter with reference to the accompanying drawings, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Figure 1:
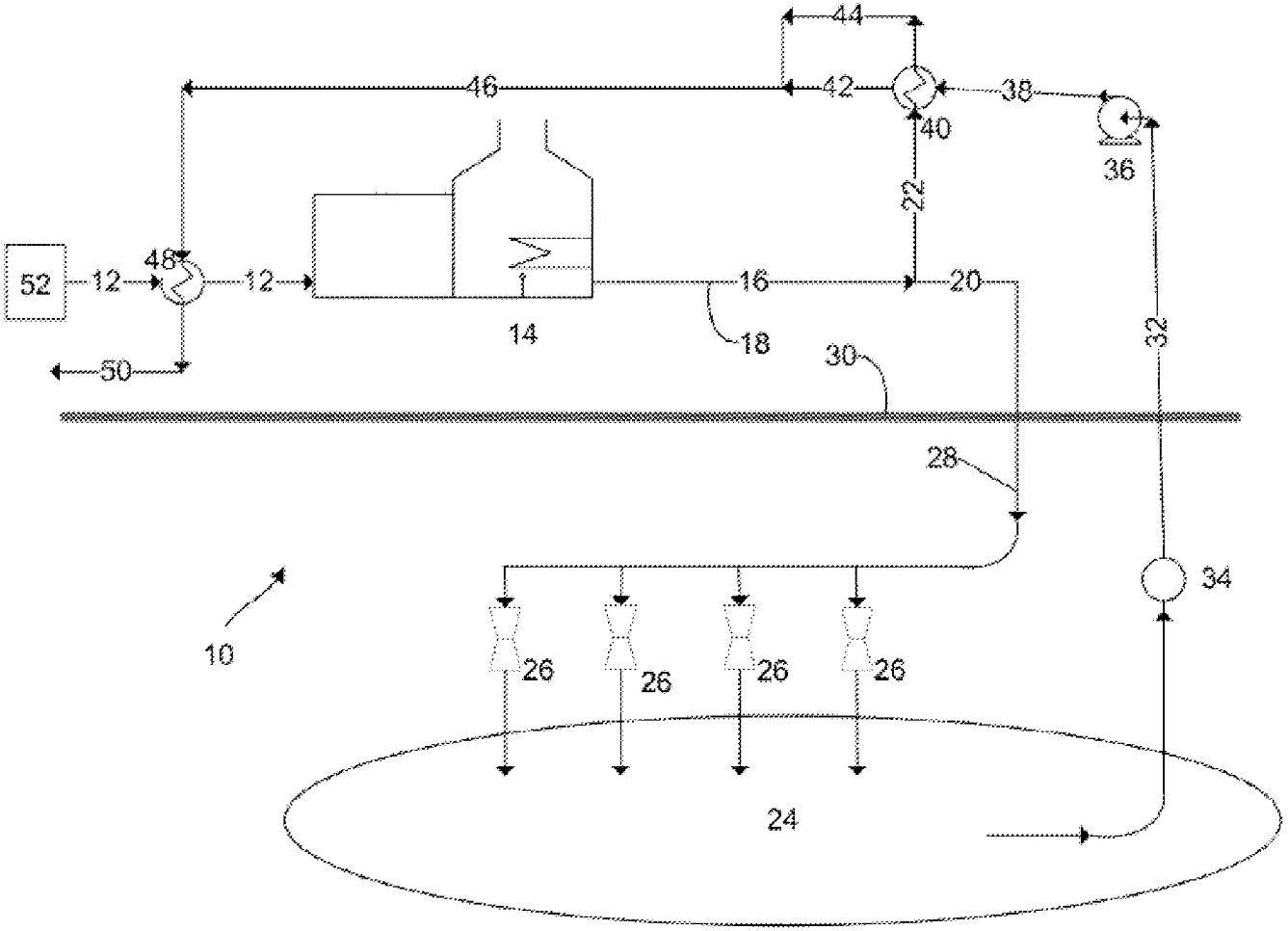
FIG. 1 is a schematic illustration of a system according to one embodiment of the present disclosure, showing a process for recovery and partial upgrading for transportation of hydrocarbon fluids.

Embodiments describing the process of the present disclosure are referenced in FIG. 1. More specifically, the following embodiments describe a system 10 and processes for implementing the present disclosure.

In the system 10 of FIG. 1, a stream of aqueous fluid, i.e., boiler feed water 12, is input from a source 52 into a water heater 14 for a heating operation. Examples of the boiler feed water include drinking water, treated wastewater, untreated wastewater, river water, lake water, seawater, produced water (such as from a hydrocarbon production operation) or mixtures thereof, and it is appreciated that the boiler feed water can include water with various materials dissolved or otherwise contained in it. The boiler feed water 12 is typically provided in a liquid phase and in the temperature range of about 0 to 100° C.

Examples of the water heater 14 include oilfield-type steam generators and gas turbine/generator cogeneration heat recovery steam generators, modified to heat the feed water 12 to supercritical conditions. In particular, the water heater 14 can be modified with upgraded tubing materials and schedules designed for high pressure in the range of about 3205 to 4060 psig and a temperature in the range of about 374° C. to 455° C. and a capacity in the range of about 50 to 150 millions btu/hr or higher. In one embodiment based on this design, the heating operation performed in the water heater 14 generates high pressure, dense phase fluid at a temperature from 374 to 1000° C. and a pressure from 3205 to 10000 psia. At these conditions, the aqueous fluid is considered to be in a supercritical dense phase.

A stream of the supercritical dense phase fluid 16 resulting from the heating operation is output from the water heater 14 into a delivery system 18, such as high pressure piping having a diameter in the range of about 6 to 61 cm. Based on this design, supercritical dense phase fluid can be distributed for long distances, and there is typically no longer a need for equal phase splitting to maintain steam quality in the distribution system 18 as is typically performed in conventional sub-critical two-phase steam delivery systems. Although the requirements for the pipe material strength and wall thickness of the pipes used in the delivery system 18 may be relatively greater than those used in conventional sub-critical delivery systems, the overall cost of the system can be substantially reduced due to the lower hoopstresses and cost of smaller diameter piping. Also, as long as the pressure is adequately maintained in the delivery system 18, there is less potential for transient water head impact and resulting vibrations ("steam hammer" effects) that are experienced in conventional delivery systems, and any vibrations and acoustics generated by such steam hammer effects would typically act on smaller piping surface areas with smaller forces in the present delivery system 18 as compared to the larger internal piping surfaces and steam hammer forces associated with conventional sub-critical delivery systems.

The stream 16 from the heater 14 is split into first and second streams of aqueous fluids, such as a reservoir feed stream 20 and a wellbore or pipeline feed stream 22 as shown in FIG. 1. The feedrate split ratio (expressed as the mass flow rate of the reservoir feed stream to the mass flow rate of the pipeline feed stream) is typically in the range of about 1:0.5 to 1:2, typically depending upon the maturity of the steamflood.

The reservoir feed stream 20 is injected into a subterranean reservoir 24 via one or more venturi chokes 26 or other appropriate choking devices. The system 10 can be used to deliver the feed stream 20 to a variety of different types of reservoirs. In some representative examples, the reservoir 24 is a sandstone, diatomite, shale oil, or carbonate heavy petroleum crude oil or tar sand bitumen reservoirs.

The one or more venturi chokes 26 are typically installed in a well 28 that extends subterraneously at least partially vertically and/or horizontally from the ground surface 30, such as in the horizontal portion of the well 28 illustrated in FIG. 1. In one embodiment, the venturi choke 26 includes a hardened steel alloy or tungsten carbide coated venturi choke projectile that can be installed with a perforating gun that perforates the steel and concrete casing of the well after the well is drilled and completed, typically by disposing a string of steel casing or liner in the well and surrounding the it with concrete. If the chokes 26 are installed in this manner, it is not necessary to use well bore equipment, such as wellbore latent heat profile control devices, and this can simplify the installation, particularly in horizontal wells where installing and retrieving tubing and cup-packer chokes can be difficult due to the heel bend (or other nonlinearities along the length of the well) and build-up of sand at the bottom of the casing.

As the reservoir feed stream 20 passes though the venturi choke(s) 26, at least a portion of the supercritical phase water flashes to higher quality steam at the reservoir conditions. In one embodiment, the supercritical phase water flashes to a range of about 70 to 100% steam quality or, superheated steam, across the venturi choke 26. Additionally, if there is near wellbore damage that reduces permeability in a particular area, the venturi choke 26 can aid recovery, e.g., 70% of the initial pressure (as provided at the outlet of the water heater 14 to the delivery system 18), such that the injected fluid has ample pressure for near-wellbore reservoir fracture and drive mechanisms.

A stream of hydrocarbon fluids 32 is recovered from the reservoir 24, typically via a submersible pump 34 and/or a high pressure pump 36 at a pressure in the range of about 3200 to 3500 psig at the pump 36 discharge and is output into a high pressure producer wellbore or oil gathering pipeline stream 38. The producer wellbore or high pressure oil gathering pipeline stream 38 can be heated via a heat exchanger 40 to a temperature in the range of about 374 to 400° C. by thermal transfer from the pipeline feed stream 22, and the stream 38 is thereby heated to form an output stream 42.

The pipeline feed stream 22 is output from the heat exchanger 40 as an output stream 44. In one embodiment, the stream 44 is mixed with stream 42, thereby resulting in the mixing of the supercritical phase water of stream 44 and the hydrocarbons of stream 42. The oil and water from streams 38 and 22 should typically have sufficient thermal energy and be subject to sufficient mixing so that the combined stream 46 has conditions sufficient to upgrade at least a portion of the hydrocarbons as it flows through a wellbore or production pipeline downstream of the mixing.

After the two streams 42, 44 are mixed; they are allowed to react under temperature and pressure conditions of supercritical water, i.e., supercritical water conditions, in the absence of externally added hydrogen, for a residence time sufficient to allow at least partial upgrading reactions to occur. The reaction can be allowed to occur in the absence of externally added catalysts or promoters, or such catalysts and promoters can be used in accordance with other embodiments of the present disclosure.

"Hydrogen" as used herein in the phrase, "in the absence of externally added hydrogen," means hydrogen gas. This phrase is not intended to exclude all sources of hydrogen that are available as reactants. Other molecules, such as saturated hydrocarbons, may act as a hydrogen source during the reaction by donating hydrogen to other unsaturated hydrocarbons. In addition, H.sub.2 may be formed in-situ during the reaction through steam reforming of hydrocarbons and water-gas-shift reaction.

Supercritical water conditions typically include a temperature from 374° C. (the critical temperature of water) to 1000° C., preferably from 374° C. to 600° C. and most preferably from 374° C. to 455 C, a pressure from 3,205 (the critical pressure of water) to 10,000 psia, preferably from 3,205 psia to 7,200 psia and most preferably from 3,205 to 4,060 psia, an oil/water volume ratio from 1:0.1 to 1:10, preferably from 1:0.5 to 1:3 and most preferably about 1:1 to 1:2.

The reactants of the combined stream 46 are allowed to react under these conditions for a sufficient time to allow at least partial upgrading reactions to occur, i.e., for a reduction in viscosity. The residence time can be selected to allow the upgrading reactions to occur selectively and to the fullest extent without having undesirable side reactions of coking or residue formation. Typical residence times may be from 1 minute to 6 hours, preferably from 8 minutes to 2 hours and most preferably from 20 to 40 minutes.

While not being bound to any theory of operation, it is believed that a number of upgrading reactions are occurring simultaneously at the supercritical reaction conditions used in the present process. In a preferred embodiment of the disclosure the major chemical upgrading reactions are believed to be:

Thermal Cracking: $C_xH_y \rightarrow$ lighter hydrocarbons

Steam Reforming: $C_xH_y+2xH_2O=xCO_2+(2x+y/2)H_2$

Water-Gas-Shill: $CO+H_2O=CO_2+H_2$

Demetalization: $C_xH_yNi_w+H_2O/H_2 \rightarrow NiO/Ni(OH)_2+$ lighter hydrocarbons Desulfurization: $C_xH_yS_z+H_2O/H_2=H_2S+$lighter by carbons The exact pathway may depend on the wellbore or pipeline conditions (temperature, pressure, oil/water volume ratio) and the hydrocarbon feedstock.

The combined stream 46 is input to a heat exchanger 48, in which thermal energy from the combined stream is transferred to the stream of boiler feed water 12, thereby cooling the production hydrocarbons in the combined stream 46 and preheating the boiler feed water 12 before the feed water 12 enters the water heater 14. The pressure of the combined stream 50 exiting the heat exchanger 48 can be reduced to an appropriate pressure for transportation of the partially upgraded, lower viscosity production stream to an upgrader or refinery for further processing. In some cases, the upgrading accomplished by the combination of the streams 38, 22 can eliminate the need for a conventional field upgrader.

Figure 2:
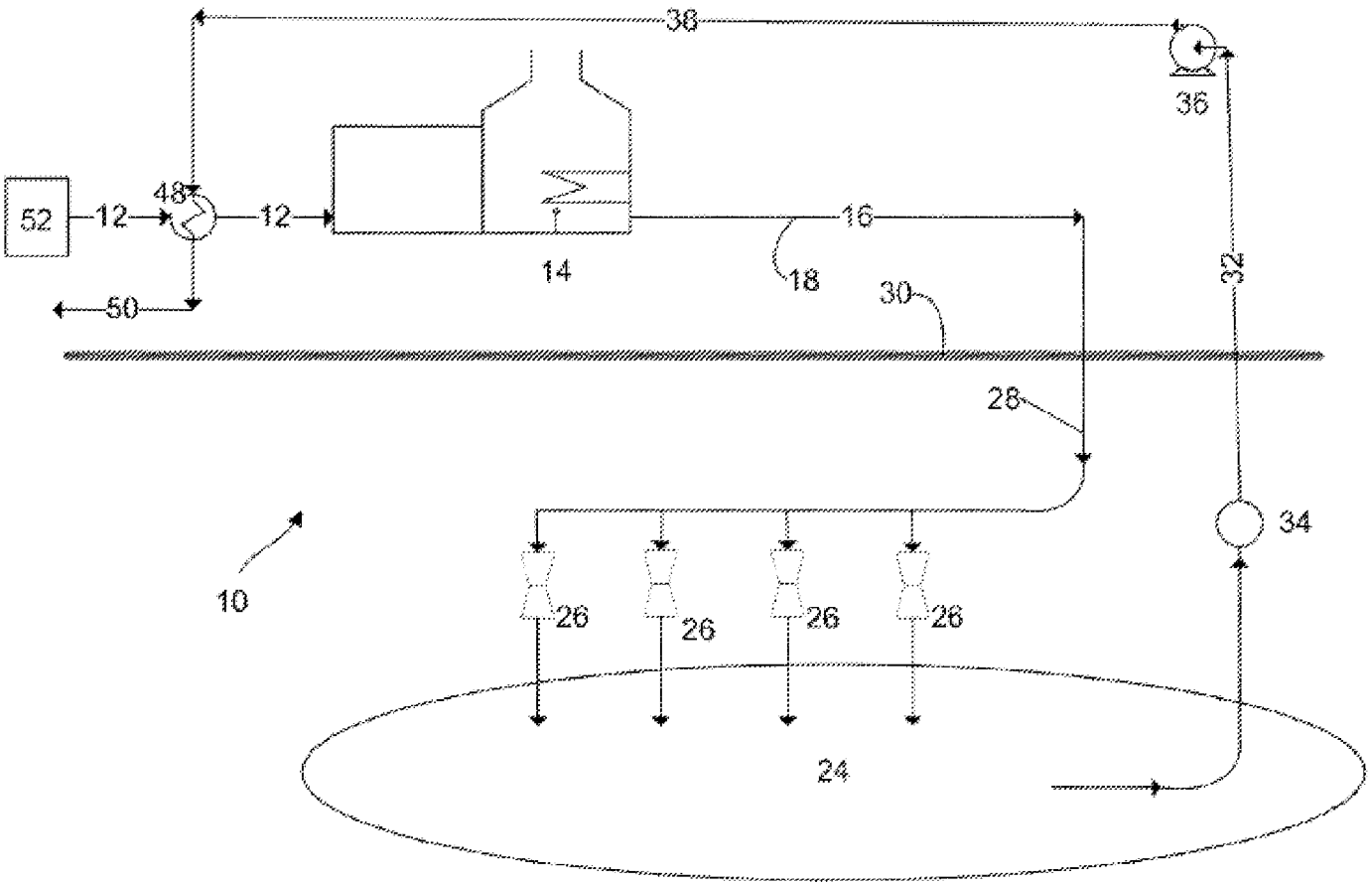
FIG. 2 is a schematic illustration of a system according to another embodiment of the present disclosure, configured to omit an upgrading operation illustrated in FIG. 1.

In other embodiments of the present disclosure, the upgrading aspect described above can be accomplished in other manners. For example, the pipeline feed stream 22 can be provided separately from the reservoir feed stream 20 and/or by a separate heating device. Alternatively, the upgrading operation that is illustrated in FIG. 1 can be omitted from the system 10. For example, the system 10 illustrated in FIG. 2 is configured to provide the stream 16 as the reservoir feed stream, i.e., without splitting the stream 16 to provide a pipeline feed stream 22. The system of FIG. 2 also omits the heat exchanger 40 of FIG. 1. The stream 38 is not combined with a stream of supercritical water but is instead provided to the heat exchanger 48 for pre-heating the feed water 12. The stream 38 then exits the heat exchanger 48 and can be transported to a refinery for upgrading and/or further processing.

Additional Embodiments

In one aspect the present application pertains to a process for recovering hydrocarbons, the process generally comprises making a supercritical dense phase fluid comprising water suitable for heating hydrocarbons. The supercritical dense phase fluid may be made in any convenient manner using conventional equipment. Generally, the supercritical dense phase fluid is generated by heating water to a supercritical dense phase. Typically, this is conducted at a temperature of from 374° C. to 1000° C. and a pressure from 3205 to 10000 psia. The supercritical dense phase fluid may be made at a surface location or below ground near in an underground hydrocarbon reservoir or both. In some embodiments the supercritical dense phase is made using an oilfield steam generator (forced flow or otherwise) as shown in, for example, FIGS. 3-7.

The supercritical phase fluid may then be isentropically expanded to a range of from about 60%, or from about 70%, or from about 80%, or from about 90% up to about 100% steam quality of subcritical or superheated steam. Isentropic expansion is used herein to mean that the expansion is substantially adiabatic and/or substantially reversible. That is, the majority, e.g., greater than 60%, or greater than 80%, or greater than 90%, or greater than 99% of the mechanical energy of water is not extracted. Alternatively or additionally, the isentropic or adiabatic efficiency is, for example, greater than 60%, or greater than 80%, or greater than 90%, or greater than 95%, or even greater than 99%.

The specific isentropic expansion device employed in the process and/or system is not particularly critical so long as the desired steam quality output is obtained. In some embodiments, one or more, or two or more, or even three or more isentropic devices may be employed in a particular system or process. Typically, such devices employ a flow path geometry that lead to the desired isentropic effect and/or desired steam quality. Suitable such devices include flow control devices such as an orifice that reduces fluid pressure due to, for example, constriction such as the venturi chokes described above.

The location of one or more isentropic devices and corresponding isentropic expansion may vary depending upon the type of system, equipment employed, desired steam quality, type of hydrocarbons, etc. Typically, the device or devices are located at or near a location where high quality or superheated steam is desired. In some systems that employ, for example, a distribution piping system operably connected to an oilfield steam generator, one or more isentropic expansion devices may be upstream or downstream or both of the distribution piping system. Similarly, for systems that may include an injection system for injecting supercritical fluid, subcritical fluid, or superheated steam, one or more isentropic devices may be upstream or downstream or both of the injection system. For example, one or more isentropic devices may be located at or near an outlet or inlet of one or more of a boiler, a pipe system, or an injection system. Thus, one or more devices may be located (a) at or near an outlet of a superheater of, for example, an oilfield steam generator, and/or (b) at or near an inlet or outlet of a distribution piping system, and/or (c) at or near an inlet or outlet of an injection system, and/or (d) at, near, or within a hydrocarbon reservoir, and/or (e) at or near a subsurface location, and/or (f) any combination of the aforementioned potential locations.

After isentropic expansion to make a desired quality of subcritical or superheated steam, e.g., isentropically expanded supercritical phase fluid, the steam may be contacted with hydrocarbons. The hydrocarbons may be at any suitable location but typically are within an underground or subsea hydrocarbon reservoir.

Figure 3:
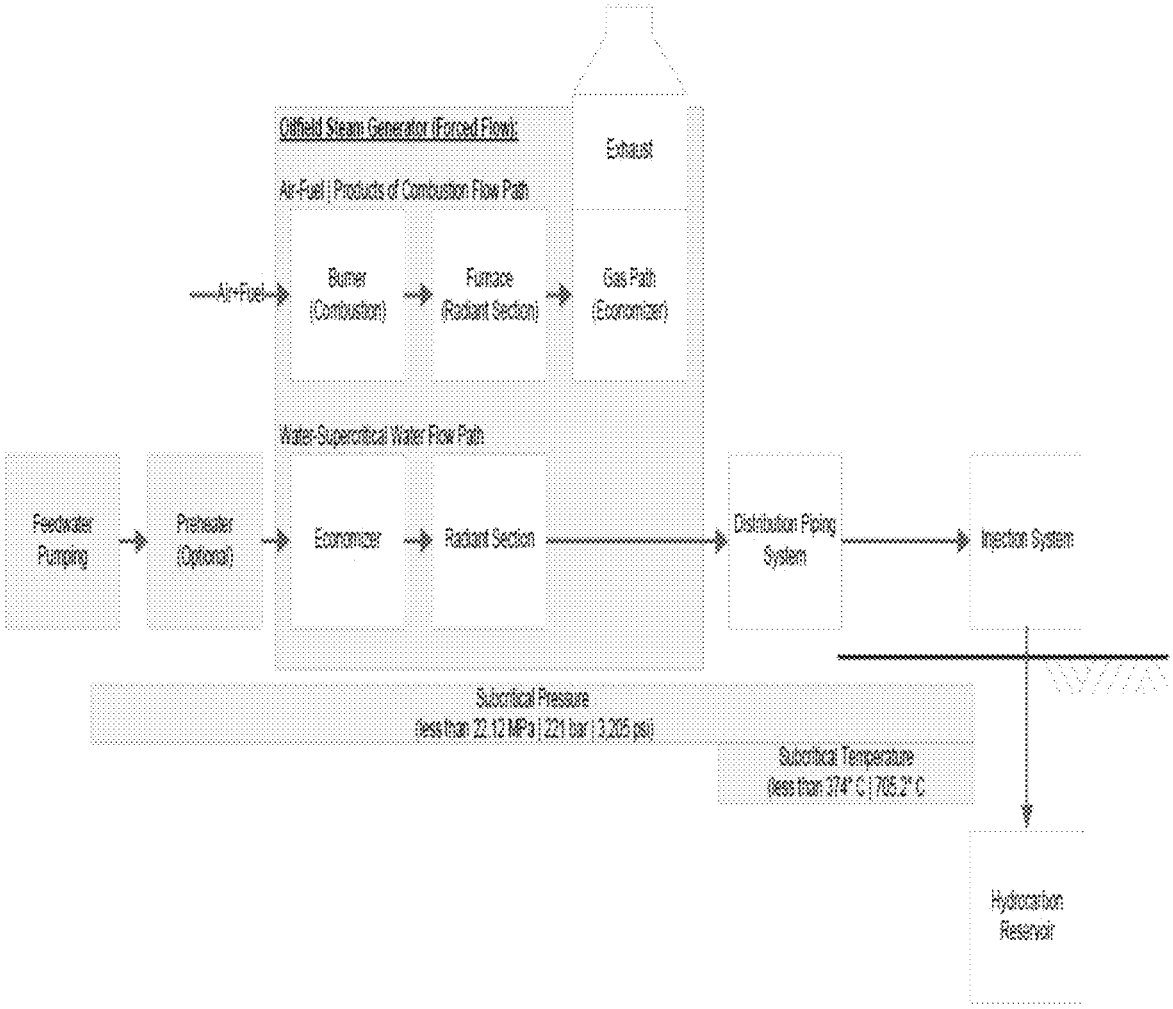
FIG. 3 is a simplified block diagram showing a fluid injection into a hydrocarbon reservoir in the absence of isentropic expansion.

FIG. 3 shows a simplified block diagram showing a fluid injection into a hydrocarbon reservoir in the absence of isentropic expansion. FIG. 3 employs an oilfield steam generator with forced flow to generate subcritical fluid. The subcritical fluid is then sent to an injection system through a distribution piping system. The injection system then delivers the subcritical fluid to a hydrocarbon reservoir.

Figure 4:
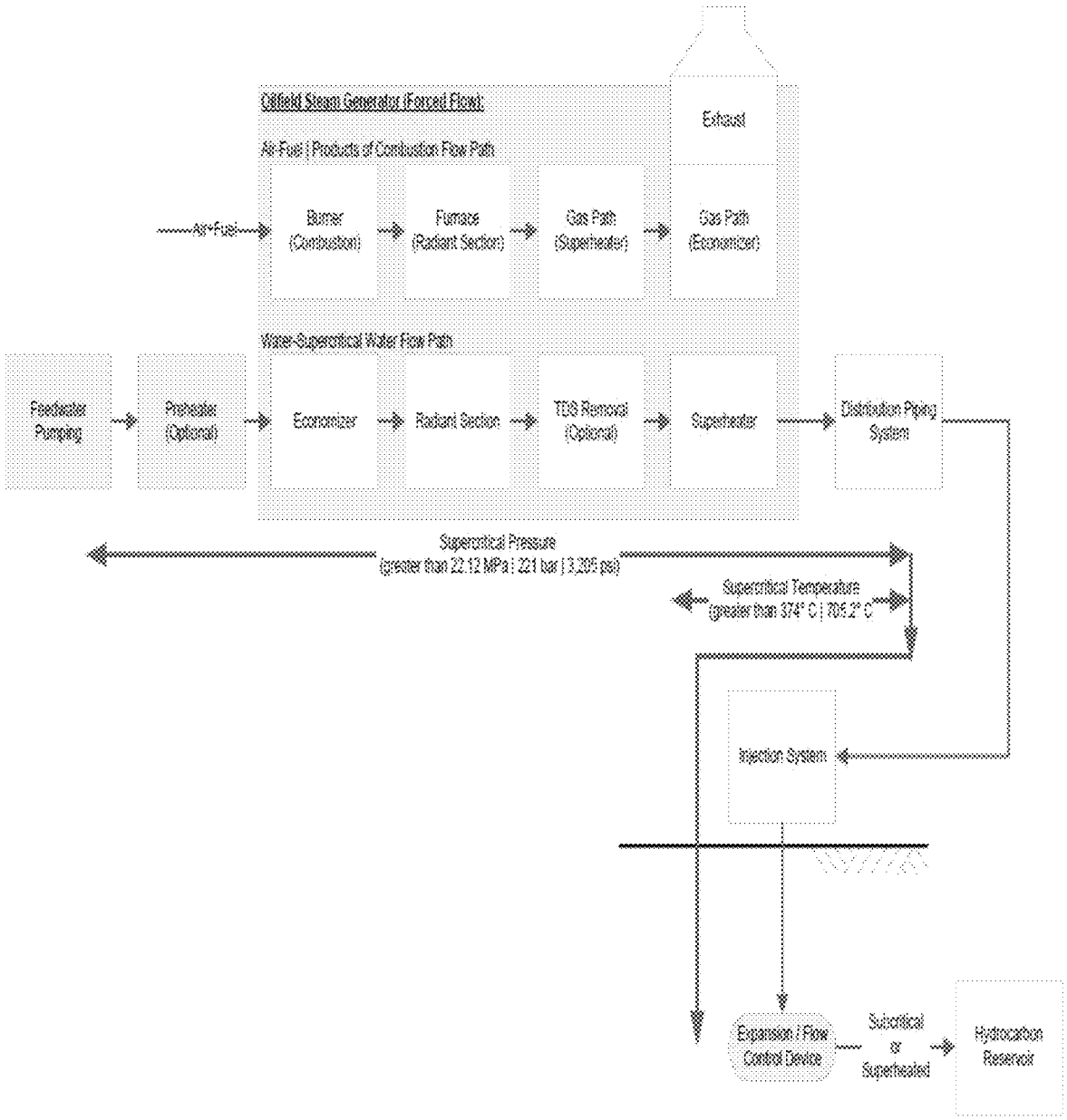
FIG. 4 is a simplified block diagram showing a supercritical injection into a hydrocarbon reservoir using at least one subsurface isentropic expansion device.
Figure 5:
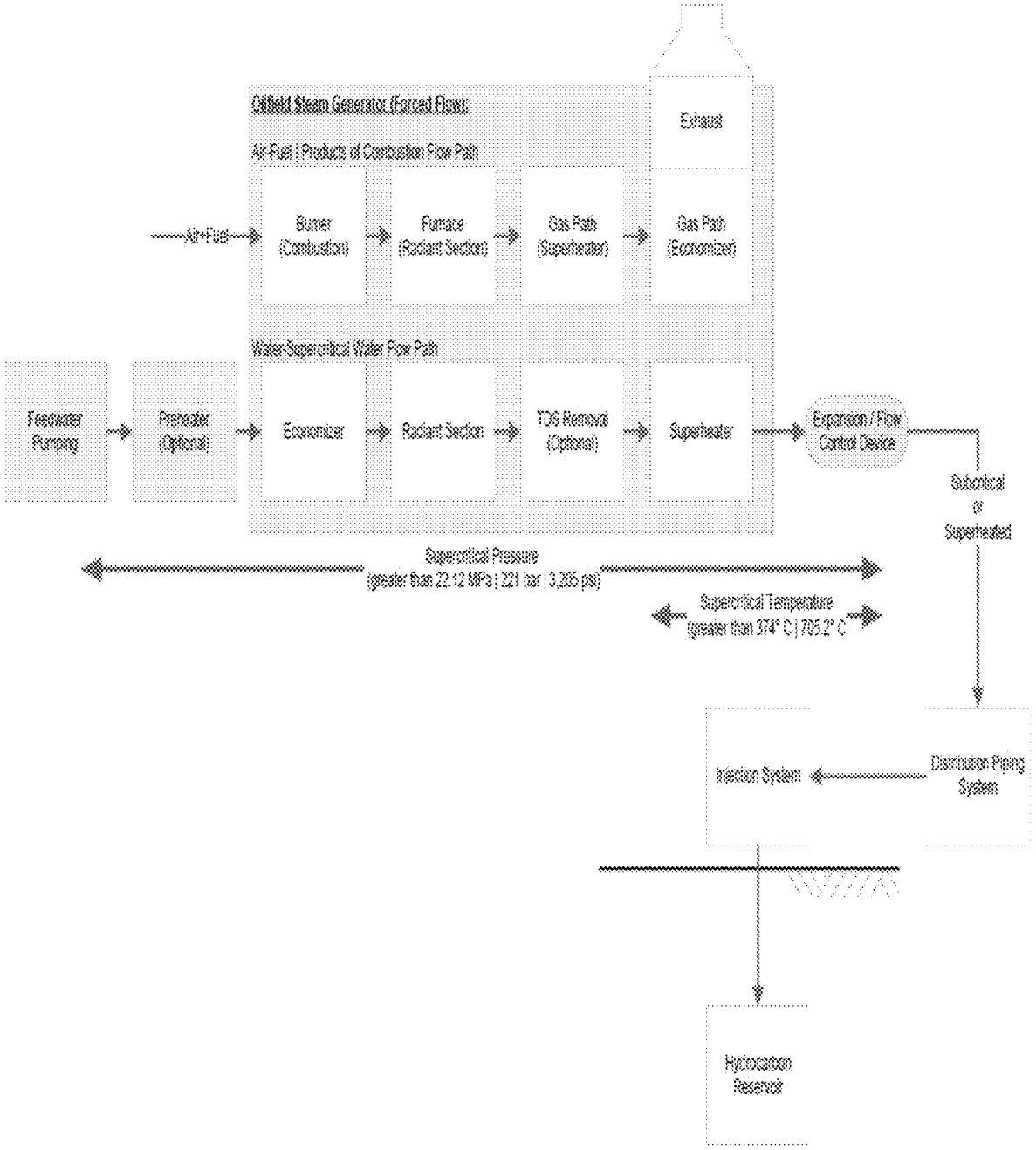
FIG. 5 is a simplified block diagram showing a supercritical injection into a hydrocarbon reservoir using at least one isentropic expansion device at or near a boiler outlet.
Figure 6:
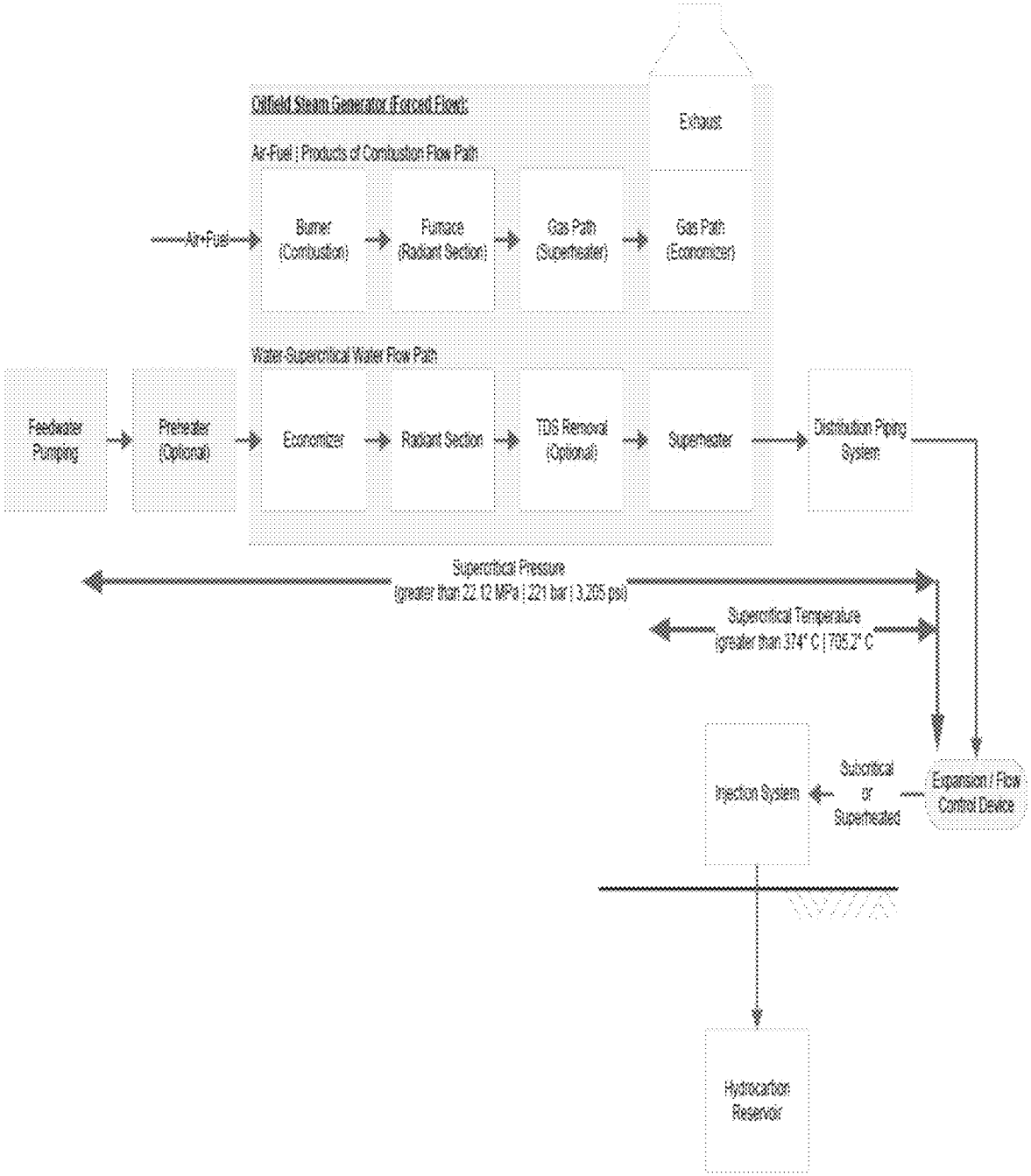
FIG. 6 is a simplified block diagram showing a supercritical injection into a hydrocarbon reservoir using at least one isentropic expansion device subsequent to any distribution piping system and/or prior to any injection system.

FIGS. 4-6 show representative embodiments for a supercritical system. In contrast to the the subcritical system in FIG. 3 the oilfield steam generator in the supercritical systems of FIGS. 4-6 employ a superheater in the path of the gas and water flow. The superheater may be preceded by the removal of total dissolved solids if desired. The type and capacity of superheater is not particularly critical so long as the desired fluid output parameters of temperature, pressure, flow rate, etc. can be reached. As shown in FIGS. 4-6 one or more expansion/flow control devices can be located in one or places within the systems to be used as an isentropic expansion device. While each of FIGS. 4-6 show only one expansion/flow control device it should be understood that there may be multiple devices in multiple combinations.

Figure 7:
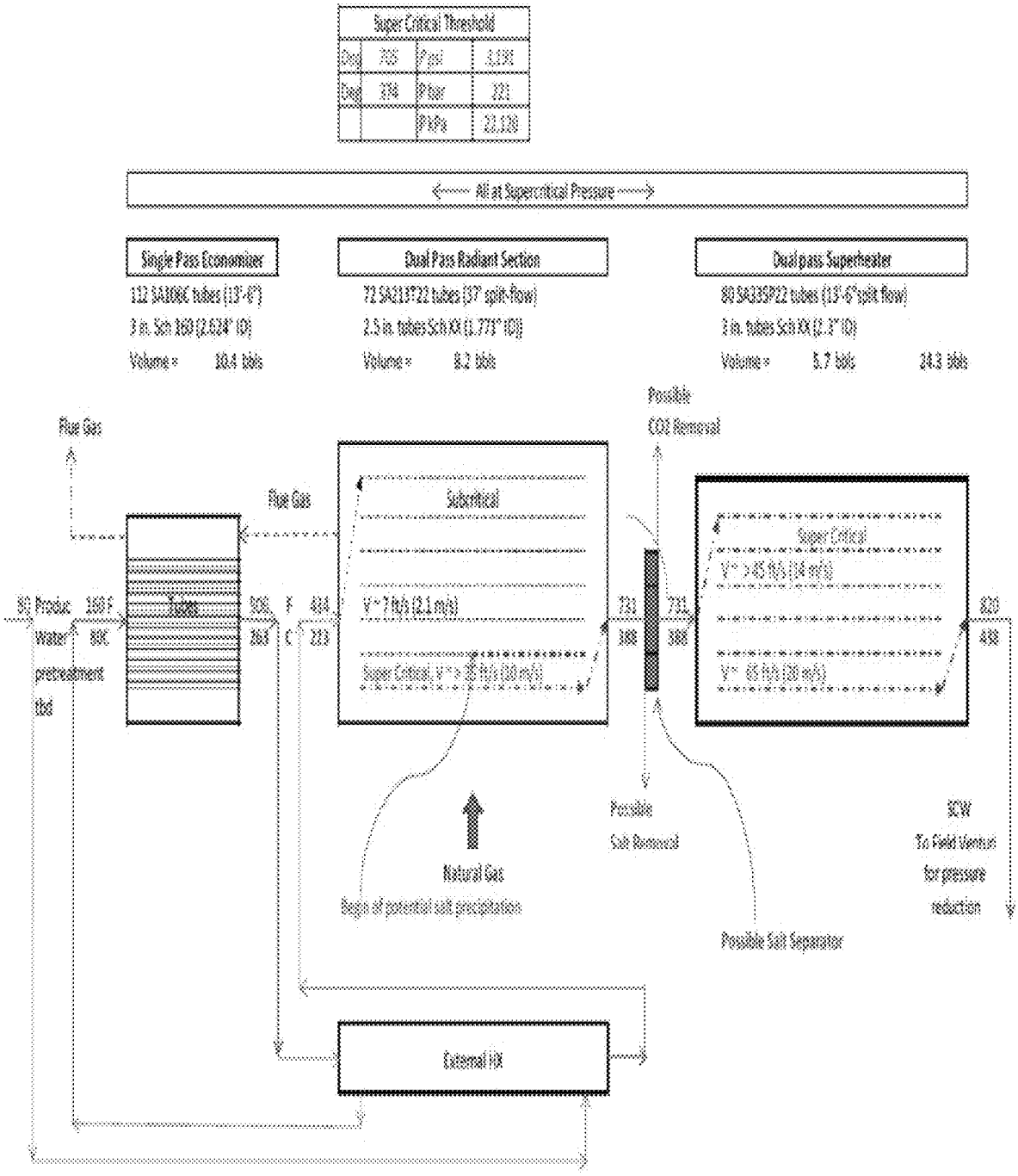
FIG. 7 is a diagram showing supercritical water (SCW) in relation to a once through steam generator (OTSG).

FIG. 7 shows a general concept of supercritical water generation in a once through steam generator (OTSG) using an economizer, radiant section, and superheater. The number of tubes, diameters, and volume of the economizer, radiant section, and superheater of course can vary depending upon the number of passes, desired throughput, desired capacity and other factors. Similarly, while FIG. 7 refers to field venturi for pressure reduction it should be understood that any isentropic device or devices may be employed instead of, or in addition to, venturi. Of course, a once through steam generator is not critical to the systems and processes employed and any convenient manner may be employed to generate the supercritical water that is sent to the field venturi, e.g., isentropic expansion devices for pressure reduction.

Other Definitions

The terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

The term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have elements that do not differ from the literal language of the claims, or if they include equivalent elements with insubstantial differences from the literal language of the claims.

Unless defined otherwise, all technical and scientific terms used herein have the same meanings as commonly understood by one of skill in the art to which the disclosed invention belongs. All citations referred herein are expressly incorporated by reference.

Many modifications and other embodiments of the present disclosure set forth herein will come to mind to one skilled in the art to which the present disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

Specific Embodiments

1. A process for recovering hydrocarbons, comprising:

making a first supercritical dense phase fluid comprising water suitable for heating hydrocarbons, wherein the first supercritical dense phase fluid is generated by heating water to a supercritical dense phase at a temperature from 374° C. to 1000° C. and a pressure from 3205 to 10000 psia at a surface location; and flashing the first supercritical phase fluids to a range of about 70% to 100% steam quality or superheated steam to heat the hydrocarbons with the about 70% to 100% steam quality or superheated steam.

2. The process according to embodiment 1, wherein the flashing is across one or more venturi chokes.

3. The process according to embodiment 1, wherein the temperature is in a range of 374° C. to 600° C. and the pressure is from 3205 to 7200 psia.

4. The process according to embodiment 1, wherein the temperature is in a range of about 374° C. to 455° C. and the pressure is from about 3205 to 4060 psia.

5. The process according to embodiment 1, wherein the first supercritical dense phase fluid is output from an oilfield water heater into a high pressure piping having a diameter in a range of about 6 to 61 cm.

6. The process according to embodiment 1, wherein the volume ratio of the hydrocarbons to the supercritical dense phase fluid comprising water is from 1:0.1 to 1:10.

7. The process according to embodiment 1, further comprising: mixing a second supercritical dense phase fluid comprising water with the heated hydrocarbons to upgrade at least a portion of the heated hydrocarbons, wherein the step of upgrading comprises reducing the viscosity of at least a portion of the heated hydrocarbons.

8. The process according to embodiment 7, wherein the first supercritical dense phase fluid and the second supercritical dense phase fluid are generated from a modified oilfield steam generator at a surface location or modified heat recovery steam generator at a surface location.

9. A system for recovering hydrocarbons, the system comprising:

a supercritical phase fluid comprising water heated to a temperature from 374° C. to 1000° C. at a pressure from 3205 to 10000 psia;

a delivery system configured to receive the supercritical phase fluid and deliver the supercritical phase fluid to hydrocarbons to heat the hydrocarbons to reduce viscosity of at least a portion of the hydrocarbons, wherein the delivery system is configured such that the supercritical phase fluid drops in pressure and flashes to a range of about 70% to 100% steam quality or superheated steam prior to contacting the hydrocarbons; and a well configured to recover the heated hydrocarbons.

10. The system according to embodiment 9, wherein the water is at a temperature of from 374° C. to 600° C. at a pressure of from 3205 to 7200 psia and wherein the delivery system further comprises high pressure piping having a diameter in a range of about 6 to 61 cm.

11. The system according to embodiment 9, wherein the delivery system further comprises venturi chokes.

12. A process for recovering hydrocarbons, comprising:

making a supercritical dense phase fluid comprising water suitable for heating hydrocarbons, wherein the supercritical dense phase fluid is generated by heating water to a supercritical dense phase at a temperature from 374° C. to 1000° C. and a pressure from 3205 to 10000 psia at a surface location;

isentropically expanding the supercritical phase fluids to a range of about 70% to 100% steam quality or superheated steam to heat the hydrocarbons with the about 70% to 100% steam quality or superheated steam.

13. The process of embodiment 12, wherein the supercritical phase fluids are isentropically expanded by an isentropic expansion device.

14. The process of embodiment 12, which further comprises injecting the isentropically expanded supercritical phase fluids into a hydrocarbon reservoir.

15. The process of embodiment 12, which further comprises injecting the supercritical phase fluids into a hydrocarbon reservoir prior to the isentropically expanding.

16. The process of embodiment 13, wherein the isentropic expansion device is located at or near an outlet of one or more of a boiler, a pipe system, or an injection system, or at a subsurface location, or any combination thereof.

17. A system comprising:

a distribution piping system configured to receive a subcritical phase fluid, a supercritical phase fluid, or any combination thereof;

an isentropic expansion device operably connected to the distribution piping system wherein the isentropic expansion device is configured to expand the subcritical phase fluid, the supercritical phase fluid, or any combination thereof to a range of from about 70% to 100% steam quality or superheated steam prior to said 70% to 100% steam quality or superheated steam heating one or more hydrocarbons; and a well configured to recover heated hydrocarbons.

18. The system of embodiment 17, wherein the system is configured such that isentropic expansion device is either upstream or downstream of the distribution piping system.

19. The system of embodiment 17, wherein the system further comprises a superheater configured to make a supercritical phase fluid comprising water heated to a temperature from 374° C. to 1000° C. at a pressure from 3205 to 10000 psia wherein the superheater is operably connected to the distribution piping system.

20. The system of embodiment 17, wherein the system further comprises an injection system operably connected to the distribution piping system wherein the injection system is configured to inject one or more of the following into a hydrocarbon reservoir: a subcritical phase fluid, a supercritical phase fluid, 70% to 100% steam quality or superheated steam, or any combination thereof.

21. The system of embodiment 20, wherein the system is configured such that isentropic expansion device is either upstream or downstream of the injection system.

The invention claimed is:

1. A process for recovering hydrocarbons, comprising:

making a first supercritical dense phase fluid comprising water suitable for heating hydrocarbons, wherein the first supercritical dense phase fluid is generated by heating water to a supercritical dense phase at a temperature from 374° C. to 1000° C. and a pressure from 3205 to 10000 psia at a surface location; and flashing the first supercritical phase fluid to a range of about 70% to 100% steam quality or superheated steam to heat the hydrocarbons with the about 70% to 100% steam quality or superheated steam, wherein the flashing is across one or more venturi chokes.

2. The process according to claim 1, wherein the temperature is in a range of 374° C. to 600° C. and the pressure is from 3205 to 7200 psia.

3. The process according to claim 1, wherein the temperature is in a range of about 374° C. to 455° C. and the pressure is from about 3205 to 4060 psia.

4. The process according to claim 1, wherein the first supercritical dense phase fluid is output from an oilfield water heater into a high pressure piping having a diameter in a range of about 6 to 61 cm.

5. The process according to claim 1, wherein the volume ratio of the hydrocarbons to the supercritical dense phase fluid comprising water is from 1:0.1 to 1:10.

6. The process according to claim 1, further comprising: mixing a second supercritical dense phase fluid comprising water with the heated hydrocarbons to upgrade at least a portion of the heated hydrocarbons, wherein the step of upgrading comprises reducing the viscosity of at least a portion of the heated hydrocarbons.

7. The process according to claim 6, wherein the first supercritical dense phase fluid and the second supercritical dense phase fluid are generated from a modified oilfield steam generator at a surface location or modified heat recovery steam generator at a surface location.

8. A system for recovering hydrocarbons, the system comprising:

a supercritical phase fluid comprising water heated to a temperature from 374° C. to 1000° C. and a pressure from 3205 to 10000 psia;

a delivery system configured to receive the supercritical phase fluid and deliver the supercritical phase fluid to hydrocarbons to heat the hydrocarbons to reduce viscosity of at least a portion of the hydrocarbons, wherein the delivery system is configured such that the supercritical phase fluid drops in pressure and flashes to a range of about 70% to 100% steam quality or superheated steam prior to contacting the hydrocarbons, and wherein the delivery system further comprises venturi chokes; and a well configured to recover the heated hydrocarbons.

9. The system according to claim 8, wherein the water is at a temperature of from 374° C. to 600° C. at a pressure of from 3205 to 7200 psia and wherein the delivery system further comprises high pressure piping having a diameter in a range of about 6 to 61 cm.

10. A process for recovering hydrocarbons, comprising:

making a supercritical dense phase fluid comprising water suitable for heating hydrocarbons, wherein the supercritical dense phase fluid is generated by heating water to a supercritical dense phase at a temperature from 374° C. to 1000° C. and a pressure from 3205 to 10000 psia at a surface location; and isentropically expanding the supercritical phase fluids to a range of about 70% to 100% steam quality or superheated steam to heat the hydrocarbons with the about 70% to 100% steam quality or superheated steam.

11. The process of claim 10, wherein the supercritical phase fluids are isentropically expanded by an isentropic expansion device.

12. The process of claim 10, which further comprises injecting the isentropically expanded supercritical phase fluids into a hydrocarbon reservoir.

13. The process of claim 10, which further comprises injecting the supercritical phase fluids into a hydrocarbon reservoir prior to the isentropically expanding.

14. The process of claim 11, wherein the isentropic expansion device is located at or near an outlet of one or more of a boiler, a pipe system, or an injection system, or at a subsurface location, or any combination thereof.

15. A system comprising:

a distribution piping system configured to receive a subcritical phase fluid, a supercritical phase fluid, or any combination thereof;

an isentropic expansion device operably connected to the distribution piping system wherein the isentropic expansion device is configured to expand the subcritical phase fluid, the supercritical phase fluid, or any combination thereof to a range of from about 70% to 100% steam quality or superheated steam prior to said 70% to 100% steam quality or superheated steam heating one or more hydrocarbons; and a well configured to recover heated hydrocarbons.

16. The system of claim 15, wherein the system is configured such that isentropic expansion device is either upstream or downstream of the distribution piping system.

17. The system of claim 15, wherein the system further comprises a superheater configured to make a supercritical phase fluid comprising water heated to a temperature from 374° C. to 1000° C. at a pressure from 3205 to 10000 psia wherein the superheater is operably connected to the distribution piping system.

18. The system of claim 15, wherein the system further comprises an injection system operably connected to the distribution piping system wherein the injection system is configured to inject one or more of the following into a hydrocarbon reservoir: a subcritical phase fluid, a supercritical phase fluid, 70% to 100% steam quality or superheated steam, or any combination thereof.

19. The system of claim 18, wherein the system is configured such that isentropic expansion device is either upstream or downstream of the injection system.

* * * * *